United States Patent [19]

Kostylev et al.

[11] Patent Number: 4,785,898

[45] Date of Patent: Nov. 22, 1988

[54] DEVICE FOR MAKING HOLES IN SOIL

[75] Inventors: Alexandr D. Kostylev; Alexei D. Terskov; Konstantin B. Skachkov; Vladimir D. Plavskikh, all of Novosibirsk, U.S.S.R.

[73] Assignee: Institut Gornogo Dela SO AN SSSR, Novosibirsk, U.S.S.R.

[21] Appl. No.: 159,970

[22] PCT Filed: Apr. 30, 1986

[86] PCT No.: PCT/SU86/00043

§ 371 Date: Dec. 11, 1987

§ 102(e) Date: Dec. 11, 1987

[87] PCT Pub. No.: WO87/06638

PCT Pub. Date: Nov. 5, 1987

[51] Int. Cl.[4] ..... E21B 11/02; E21B 7/26

[52] U.S. Cl. ..... 175/19; 173/91; 175/296

[58] Field of Search ..... 175/19, 293, 296, 300, 175/305, 306, 323; 173/91, 134, 135, 137; 405/253, 254

[56] References Cited

U.S. PATENT DOCUMENTS 2,695,673 11/1954 Coyle ..... 166/170
3,708,023 1/1973 Nazarov et al. ..... 175/19
3,756,328 9/1973 Sudnishnikov et al. ..... 175/19 X
4,171,727 10/1979 Tkach et al. ..... 175/19
4,708,211 11/1987 Shemyakin et al. ..... 175/19

FOREIGN PATENT DOCUMENTS 1099016 6/1984 U.S.S.R. .
1134674 1/1985 U.S.S.R. .
1139808 2/1985 U.S.S.R. .

OTHER PUBLICATIONS

"Pneumatic Percussion-Type Devices and Machines for Driving Light Construction Elements in Soil", Kostylev et al., Nov. 1980.

*Primary Examiner*—Stephen J. Novosad
*Assistant Examiner*—David J. Bagnell
*Attorney, Agent, or Firm*—Burgess, Ryan & Wayne

[57] ABSTRACT

The invention relates to the construction equipment. A device comprises a body (1) internally accommodating a percussion member (2) with ports (5), an air distributing sleeve (6), an elastic element (7) and a threaded bushing (8). Grooves (9) are made on an external surface of the threaded bushing (8) at an angle to the axis of the device. When the device is moving soil gets in the grooves (9) of the threaded bushing (8) and develops a circumferential force fixing the threaded bushing (8) relative to the body (1).

4 Claims, 1 Drawing Sheet

DEVICE FOR MAKING HOLES IN SOIL

TECHNICAL FIELD

The present invention relates to pneumatic percussion-type devices used in construction and more particularly to devices for making holes in soil.

The present invention may be most advantageously utilized in devices intended for making holes in compacted soils when a trenchless (subsurface) method of laying underground service lines under roads, embankments and other structures is employed.

Self-propelled pneumatic machines of a percussion type, viz. pneumatic percussion-type devices are now widely used for making holes in compacted soils. A working member of the pneumatic percussion-type device is essentially a cylindrical body provided with an internal space. The body space internally accommodates a percussion member and an air distributing sleeve. In the pneumatic percussion device of this type the air distributing sleeve is connected to the cylindrical body by means of a threaded bushing.

When the machine is operating the percussion member actuated by compressed air delivered in the working chambers through the air distributing sleeve reciprocates axially and strikes blows at a front portion of the cylindrical body during each working cycle. Under the action of blows the cylindrical body is driven in the soil, thereby forming a hole with compacted walls. The hole diameter is practically equal to the diameter of the pneumatic percussion-type device body. In the process of operation of this pneumatic percussion-type device the cylindrical body-to-threaded bushing joint needs tightening.

BACKGROUND OF THE INVENTION

Known in the prior art is a percussion-type device for making holes in soil (cf. Pneumatic Percussion-Type Devices and Machines for Driving Light Construction Elements in Soil by Kostylev A. D., Gurkov K. S., Smolyanitsky B. N., Novosibirsk, 1980, Publishing House "Nauka", p. 9), comprising a body, a percussion member and an air distributing sleeve. The air distributing sleeve is connected to the body by means of a threaded bushing with a lock washer. In the process of operation of this device, it becomes necessary to disassemble the body-to-threaded bushing joint (for maintenance, repair, etc.); as a result, the lock washer gets out of order after two-three disassembly operations.

Also known to the prior art is a percussion-type device for making holes in soil (cf. Pneumatic Percussion-Type Devices and Machines for Driving Light Construction Elements in Soil by Kostylev A. D., Gurkov K. S., Smolyanitsky B. N., Novosibirsk, 1980, Publishing House "Nauka", p. 10), comprising a body, a percussion member and an air distributing sleeve. The air distributing sleeve is connected to the body by means of a threaded bushing. The body-to-threaded bushing joint is fixed by mating of conical surfaces of the body and threaded bushing.

In the service period this device operates in a percussion-vibration mode due to which the threaded joint works loose and operates for some time in the loosened condition which leads to failure of the thread.

Besides, substantial radial forces are developed in the body portion where the cone is made which cause destruction of the body.

In addition this device features a low operating reliability as unscrewing of the threaded bushing during operation of the device causes axial displacement of the air distributing sleeve which disturbs the operating cycle of the device. Axial displacement of the air distributing sleeve (rearwards) causes an advanced exhaust of compressed air into the front chamber of the device. This air brakes the percussion member before it strikes a blow which reduces the energy of the blow and consequently decreases the capacity of the device. During the return motion of the percussion member the front chamber of the device is kept longer under the pressure (the front edge of the air distributing sleeve is displaced rearwards). Therefore, a greater quantity of the kinetic energy is imparted to the percussion member and after the retarded exhaust of compressed air from the front chamber (the rear edge of the air distributing sleeve is also displaced rearwards) the percussion member covers a greater distance (the braking distance of the percussion member increases) and may administer blows at the front end of the threaded bushing. Thus, due to unscrewing of the threaded bushing the percussion member administers blows both at the front and rear portions of the device, thereby disturbing the mode of operation of the device which may lead to a drop in the penetration rate and cause a complete stop of the device.

The invention is aimed at providing a device for making holes in soil, wherein the design embodiment of a threaded bushing will provide stabilization of the air distributing sleeve edges in the process of the device operation in the soil.

SUMMARY OF THE INVENTION

The invention essentially resides in that in a device for making holes in soil, comprising a body which internally accommodates a percussion member adapted for reciprocating motion and forms in the body a front chamber communicated through ports of a percussion member with a rear chamber formed by a space of the percussion member and the air distributing sleeve associated through an elastic element with the threaded bushing mounted in a tail portion of the body according to the invention, the threaded bushing external surface has at least two grooves arranged diametrically oppositely to each other and at an angle to the axis of the device, the direction of inclination of the grooves being coincident with the hand of thread of the threaded bushing. The grooves made at an angle to the axis of the device contribute to the development (occurrence) of a circumferential force fixing the threaded bushing relative to the body.

It is preferred that the grooves should be made on the external surface of the threaded busing in a helix.

Such an embodiment of the device is the most simple and easy to manufacture.

It is desirable that the grooves should be arranged at an angle within a range of from 30° to 60° to the axis of the device.

Such an embodiment of the grooves provides a reliable fixing of the threaded bushing relative to the body. It should be noted that the value of a circumferential force may be regulated by changing the angle of inclination of the grooves relative to the axis of the device.

It is advantageous to make the grooves such that the depth thereof should be within a range of 2–5% of the diameter of a threaded bushing.

This provides the development of a circumferential force reliably fixing the threaded bushing relative to the body.

BRIEF DESCRIPTION OF THE DRAWINGS

The invention will now be described in greater detail with reference to a specific embodiment thereof which is illustrated in the accompanying drawings, in which.

BEST MODE FOR CARRYING OUT THE INVENTION

Figure 1:
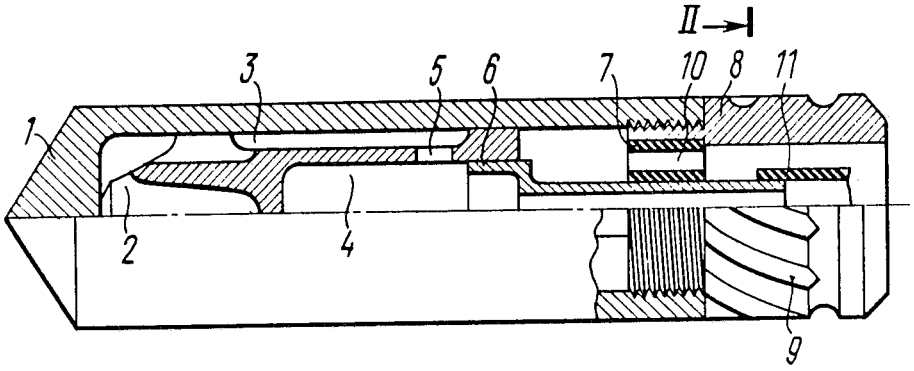
FIG. 1 illustrates a longitudinal section of the device.
Figure 2:
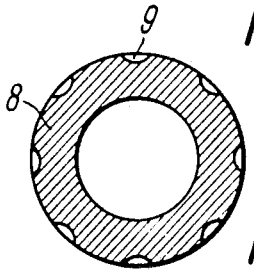
FIG. 2 illustrates a sectional view taken along the line II—II of FIG. 1.

A device for making holes in soil comprises a hollow body 1 (FIG. 1) internally accommodating a percussion member 2 adapted for reciprocating motion. A front working chamber 3 is formed by an external surface of the percussion member 2 and the body 1. Made in the percussion member 2 is a rear working chamber 4 communicated with the front working chamber 3 through ports 5 made in the wall of the percussion member 2. The rear working chamber 4 internally accommodates an air distributing sleeve 6 coupled by means of an elastic element 7 with a threaded bushing 8 mounted in the body 1 with the aid of a thread. The rear working chamber 4 is formed by a space of the percussion member 2 and the air distributing sleeve 6. Made on the external surface of the threaded bushing 8 (FIG. 2) are grooves 9 arranged at an angle of from 30° to 60° relative to the axis of the device. Depth of each of the grooves 9 is within a range of from 2 to 5% of the diameter of the threaded bushing 8. The direction of inclination of the grooves 9 coincides with the hand of thread of the threaded bushing 8. Exhaust ports 10 are provided in the elastic element 7. Compressed air is delivered to the device through a hose 11.

The device for making holes in soil operates in the following way.

From a gaseous medium source (not shown) compressed air is delivered to the device through the hose 11 secured to the air distributing sleeve 6. Compressed air is admitted in the rear chamber 4 through a central passage of the air distributing sleeve 6 and in the front chamber 3, through the ports 5 of the percussion member 2. Due to a difference in the areas of the percussion member 2 on the side of the front chamber 3 and the rear chamber 4, the percussion member 2 moves rearwards (to the right in the drawing). After the ports 5 of the percussion member 2 pass the rear edge of the air distributing sleeve 6, the compressed air will be exhausted from the front chamber 3 to the atmosphere through the ports 5 of the percussion member 2 and the port 10 in the elastic element 7. Under the action of air pressure in the rear chamber 4 the percussion member 2 stops without striking against the front end of the threaded bushing 8 and then starts moving forward (to the left in the drawing) until the ports 5 of the percussion member 2 pass the front edge of the air distributing sleeve 6. After the ports 5 are uncovered the percussion member 2 strikes a blow at the front end of the body 1, thereby driving it in the soil. Under the action of blows the device moves through the soil and makes the hole. The soil from the hole walls contacting the external surface of the threaded bushing 8 flows in the grooves 9. Due to the fact that the grooves 9 are arranged at an angle to the axis of the device (and the axis of the hole) the soil acts on the rear wall of the grooves 9 and develops a circumferential force applied to the threaded bushing 8 and directed along the hand of thread of the threaded bushing 8. Under the action of this circumferential force the threaded bushing is being constantly screwed in the body 1, thereby ensuring an unseparable joint of the body 1 and the threaded bushing 8.

Industrial Applicability

The proposed invention relates to the construction equipment and is designed for percussion-type devices used for making holes of different application in soil. Utilization of the invention makes it possible to upgrade the operating reliability of the device and also to improve the reliability and durability of the device construction.

We claim:

1. A device for making holes in soil, comprising a body (1) which internally accommodates a percussion member (2) adapted for reciprocating motion and forms in the body a front chamber (3) communicated through ports (5) of the percussion member (2) with a rear chamber (4) formed by a space of the percussion member (2) and an air distributing sleeve (6) associated through an elastic element (7) with a threaded bushing (8) mounted in a tail portion of the body (1), characterized in that the threaded bushing (8) external surface has at least two grooves (9) arranged diametrically oppositely to each other and at an angle to the axis of the device, the direction of inclination of the grooves being coincident with the hand of thread of the threaded bushing (8).

2. A device for making holes in soil as claimed in claim 1, characterized in that the grooves (9) on the external surface of the threaded bushing (8) are made in a helix.

3. A device as claimed in claim 1 or claim 2, characterized in that the angle of inclination of the grooves (9) on the external surface of the threaded bushing (8) is within a range of from 30° to 60° relative to the axis of the device.

4. A device as claimed in any one of claims 1 to 3, characterized in that the depth of each groove (9) on the external surface of the threaded bushing (8) is within a range of from 2 to 5% of the diameter of the threaded bushing (8).

* * * * *